United States Patent [19]

Van Laarhoven

[11] 4,196,674

[45] Apr. 8, 1980

[54] MULTI-LEVEL ADJUSTABLE DRAFTING TABLE CONSTRUCTION

[76] Inventor: Jacques Van Laarhoven, 6430 Crescent Ave., Apt. 5, Buena Park, Calif. 90620

[21] Appl. No.: 946,774

[22] Filed: Sep. 28, 1978

[51] Int. Cl.[2] ..... A47F 5/12; A47B 27/00; A47G 1/24

[52] U.S. Cl. ..... 108/4; 33/446; 108/8; 108/9; 248/456

[58] Field of Search ..... 248/456, 455, 460, 463, 248/136; 108/8, 9, 10, 12, 145, 144, 4; 269/254 D; 312/231; 33/80, 79 R

[56] References Cited

U.S. PATENT DOCUMENTS

| | | | |
|---|---|---|---|
| 180,052 | 3/1876 | Northrop | 248/456 |
| 836,551 | 11/1906 | Werner | 108/9 |
| 1,443,998 | 2/1923 | Meltzer | 33/80 |
| 1,829,288 | 10/1931 | May | 108/4 |
| 1,985,212 | 12/1934 | O'Farrell | 33/80 |
| 2,215,462 | 9/1940 | Davidson, Jr. et al. | 108/9 X |
| 2,795,891 | 6/1957 | Bishop | 108/9 |
| 3,094,948 | 6/1963 | Clow | 108/10 |
| 3,141,260 | 7/1964 | Dompiri | 248/455 |

FOREIGN PATENT DOCUMENTS

| | | | |
|---|---|---|---|
| 118211 | 3/1900 | Fed. Rep. of Germany | 248/455 |
| 890707 | 9/1953 | Fed. Rep. of Germany | 108/9 |
| 1303748 | 10/1961 | France | 108/9 |
| 86064 | 8/1920 | Switzerland | 248/455 |
| 950733 | 7/1964 | United Kingdom | 108/10 |

*Primary Examiner*—James T. McCall
*Attorney, Agent, or Firm*—Poms, Smith, Lande & Rose; Poms, Smith, Lande & Rose

[57] ABSTRACT

A multi-level drafting table construction including a table base supporting a drafting board, and an arrangement of link members pivotally interconnecting the drafting board and table base. One of the link members, which is pivotally interconnected at one end to the drafting board, has its other end selectively receivable in ratchet teeth provided on the table base for adjusting inclination of the drafting board in multi-level positions of the board. A front link member is pivotally connected at one end to the table base at a first pivot axis which is a common axis for inclination of the drafting board about said axis for inclination of the board in a first range of inclined positions. The front link member is pivotally connected at its other end at a second pivot axis to the drafting board to provide pivotal movement of the drafting board about said pivot axis in a different range of inclined positions and at different levels. At the different levels of the drafting board the front link member is pivoted forwardly about the first pivot axis for cooperable engagement with a stop on the table base whereby the front edge of the drafting board is elevated to its different levels which include one or more levels.

4 Claims, 10 Drawing Figures

MULTI-LEVEL ADJUSTABLE DRAFTING TABLE CONSTRUCTION

BACKGROUND OF INVENTION

This invention relates to a drafting table construction and more particularly to a drawing board readily ajustable to different levels and adjustable to selected inclined positions at each level.

Prior proposed drafting tabel constructions were provided with a drafting board hinged adjacent its front edge to the table frame and providee with arms pivotally connected adjacent the rear edge of the table and adjustably connected with the table frame for raising and lowering the rear edge of the table to adjust the table to a selected inclination. In some instances the table frame and its pivotal connection to the front edge of the drafting board were capable of vertical adjustment to raise the front edge of the drafting board (U.S. Pat. No. 2,215,462). Vertical adjustment of the board and its inclination was provided in a different manner by vertically adjustable front and back legs interconnecting the board with a base (U.S. Pat. No. 2,554,599). Another arrangement of such vertical and angular adjustment of a drawing board with respect to its base is shown in U.S. Pat. Nos. 2,555,575 and 2,877,074. A book support or desk utilizing a hinged series of pawls or arms of unequal length to adjust the neight and to adjust the inclination is shown in U.S. Pat. No. 180,052.

In some prior proposed drafting table constructions, adjustment of the height of the table required several steps, namely first uniformly and evenly raising the table and then securing each of said legs. The securement means included pins inserted into a selected hole or included frictional holding of each leg by tightening a knob to frictionally retain the leg in a selected position. Adjustment of the height of the table by one person was often awkward and time consuming because of binding of the several parts when attempting to uniformly lift both sides of the board and because drafting boards provided with drafting equipment and machines mounted thereon were relatively unbalanced and heavy for one person to handle. Preferably height adjustment was made by two persons, one at each side of the board, so that the board could be uniformly lifted.

It is desirable that a drafting board be conveniently adjustable with respect to height and inclination at each height and that such adjustment be readily made without assistance from another person and preferably in substantially one continuous motion.

SUMMARY OF INVENTION

The present invention contemplates a novel drafting table construction in wich a drafting board is so mounted relative to a table base that the drafting board may be place at either one of several levels with great facility. The present invention contemplates that a single person may adjust the drafting board to multi-level positions and almost simultaneously adjust the board to a desired inclination. Multi-level adjustment of the drafting board of this invention is generally designed so that the board will have a low position for the draftsman to sit at the table and a higher position for the draftsman to stand at the table when he so desires. Further, different positioning of the board with respect to height and inclination may be desired by the draftsman to work on different areas of the board, for example, a steeper inclination of the board for work near the top of the board, or less inclination of the board for work near the bottom of the board. The work area of the board may also relate to a change in height of the board and to wheter the draftsman is standing, sitting on a high stool, or sitting on a low stool.

The primary object of the present invention is to disclose a novel multi-level drafting table construction which is readily adjusted to each of the multi-level positions and which is readily selectively inclined in each of said multi-level positions.

An object of the invention is to provide a novel drafting table construction embodying a simplified arrangement for mounting a drafting board on a table base.

Another object of the invention is to provide a drafting table construction in which the drafting board is stable in any of its selected positions and which is readily adjustable under loaded conditions as imposed by relativey heavy drafting equipment mounted on the board.

A further object of the present invention is to provide a novel multi-level drafting table construction in which the drafting table is mounted with respect to the table base in such a manner that all of the space in the table base is available for drafting accessories without interference with the adjustment of the drafting board into a selected position.

A still further object of the invention is to disclose a drafting table construction in which the drafting board may be elevated and inclined by one person at the front of the table without manipulation of pins, bolts, and knobs usually located in prior devices beneath and at the rear of the drafting board and table.

Another object of the invention is to disclose a drafting table construction in which the drafting board is stabilized by gravitational forces acting on the supporting link members and table base, such stability being present in each multi-level position of the board.

The invention particularly relates to a drafting table construction having a first means for selectively adjusting the inclination of a drafting board at one level, a second means for selectively adjusting the inclination of the drafting board into several positions at a second level, the second means including a front link member pivotally connected to the front portion of a table base and pivotally connected at its opposite end to the front portion of the drafting board, stop means on the table base for limiting forward movement of the link member, and inclined positioning means pivotally connected to the drafting board and adjustably selectively connected to the table base for determining desired inclination of the board in multi-level positions.

Various other objects and advantages of the present invention will be readily apparent from the following description of the drawings in which exemplary embodiments of the invention are shown.

IN THE DRAWINGS

Figures 1, 2, 3, 4, 10:
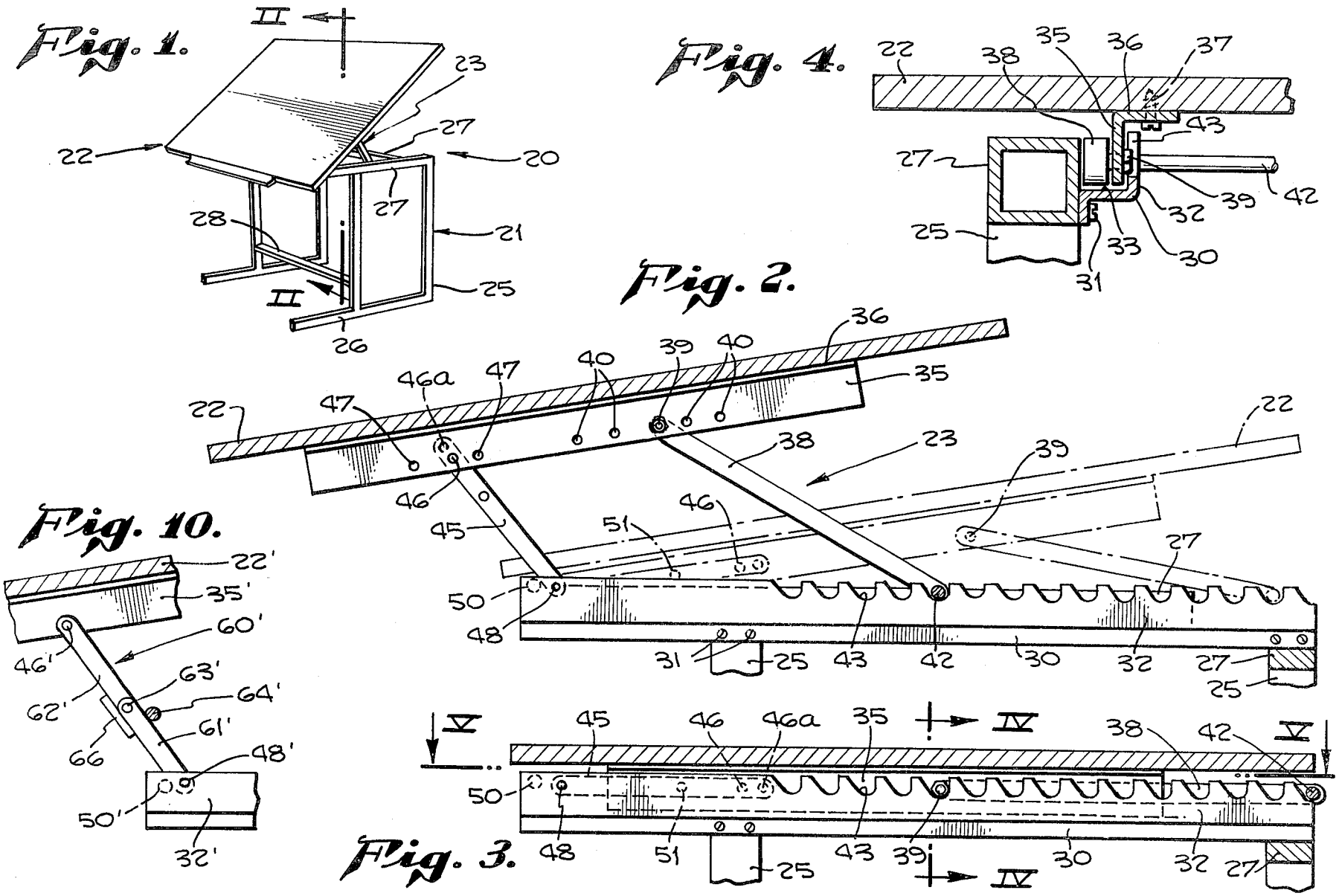
FIG. 1 is a perspective view of a drafting table construction embodying this invention.
FIG. 2 is a fragmentary vertical sectional view taken in the plane indicated by line II—II of FIG. 1 and showing the drafting board in elevated position at an inclined angle less than shown in FIG. 1, and also showing in phantom lines the drafting board in lower position to illustrate the multi-level feature of this invention.
FIG. 3 is a sectional view similar to FIG. 2 and showing the drafting board in fully collapsed horizontal position.
FIG. 4 is an enlarged fragmentary sectional view taken in the plane indicated by line IV—IV of FIG. 3.
FIG. 10 is a fragmentary view of link means shown in FIG. 6 showing the link elements in linear extended relation to provide a third elevated level for positioning of the board.
Figure 5:
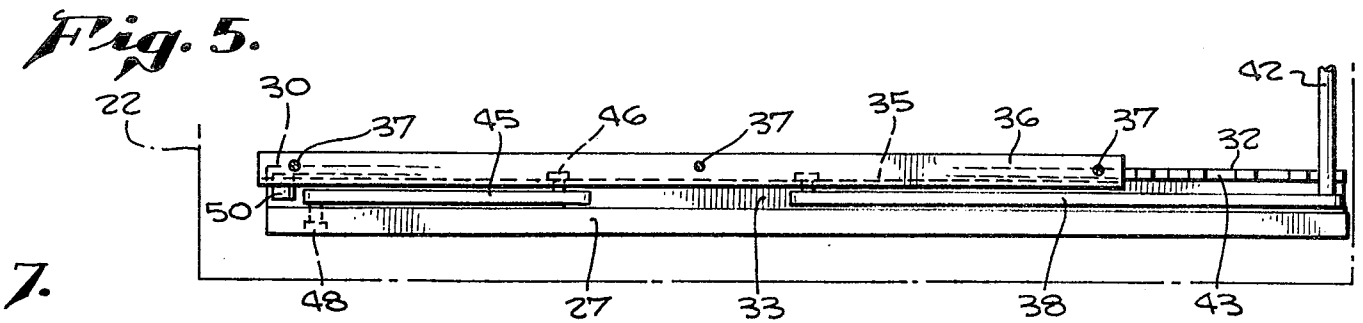
FIG. 5 is a fragmentary sectional view taken in the plane indicated by line V—V of FIG. 3, the drafting board being fragmentarily indicated in phantom lines.
Figure 6:
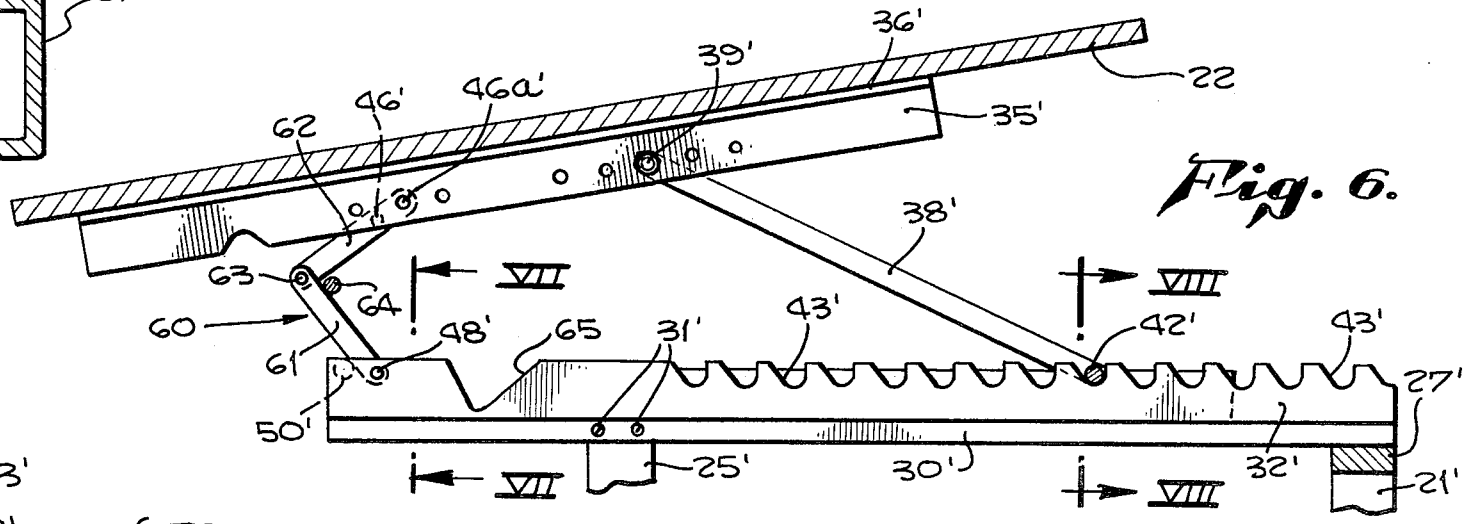
FIG. 6 is a fragmentary sectional view of a drafting table construction embodying a modification of this invention, the section being taken in plane similar to that of FIG. 2.

A drafting table construction embodying this invention and generally indicated at 20 in FIG. 1 may include a table base 21, a drafting board 22, and means 23 interconnecting and adjustably supporting drafting board 22 for multi-level positioning as shown in FIGS. 2,6, and 10. Table base 21 may comprise any suitable arrangement of vertical frame members 25 interconnected by horizontal bottom, top, and intermediate frame members 26, 27, 28 respectively. Frame members 25,26 and 27 may be made of tubular polygonal section metal stock and suitably welded to provide table base 21. The open space beneath the top horizontal frame members 27 may be utilized for drafting table accessories in the form of suitable shelves, drawers or compartments as desired. One of the features of the present drafting table construction is that the drafting board 22 is readily adjusted to multi-level positions without utilization of space beneath the top horizontal frame members 27.

Drafting board 22 may be rectangular and may be of suitable dimensions and material. It is contemplated that drafting equipment and drafting machines (not shown) of well known manufacture may be carried by the drafting board and fixed thereto for use by the draftsman in well known manner. Such drafting equipment is relatively heavy and support of the draftng board from the table base is required to be sturdy and stable.

Multi-level positioning means 23 interconnecting drafting board 22 with table base 21 may comprise a pair of base rails 30 each secured to top side horizontal base frame members 27 by suitable means such as welding, screws or bolts at 31. Each base rail 30 may be of Z section having an upstanding inboard longitudinally extending flange 32 forming a longitudinally extending channel 33 with base frame member 27 to receive depending flange 35 of a board rail 36 of angle section secured in suitable manner as by screwbolts 37 to board 22. The width of channel 33 is sufficient to receive, in addition to depending flange 35, inclined positioning link member or arm 38 having a pivotal connection at 39 in a selected pivot hole 40 provided in spaced relation along board rail flange 35. The other ends of link members 38 are interconnected with a transverse rod 42 which is adapted to be received in selected aligned notches 43 provided in upstanding inboard flange 32.

At the forward position of each board rail 36 a front link member 45 is provided a pivotal connection at 46 with a selected hole 47 provided in depending flange 35 of rail 36. Link member 45 may also be provided with an auxilary hole **46*a* for an alternate pivotal connection at a hole 47 to increase the effective length of member 45. The opposite end of link member 45 is provided a pivotal connection at 48 with the inboard flange 32 of base rail 30. Link member 45 lies in the same vertical plane as positioning member 38 an similarly is adapted to be received within channel 33 defined by base frame member 27 and base rail 30**.

At low level use of drafting board 22 as shown in phantom lines in FIG. 2, link member 45 lies alongside board rail 36. Adjustment of inclination of board 22 is readily made by pivoting board 22 about the pivot axis provided by the pivotal connection at 48 and maintaining the desired inclination by positioning of rod 42 in selected notches 43 in base rail 30. Adjustment of inclination of drafting board 22 by this system of fixes pivots 48 and pivotal movement of members 38 is known and does not form part of this invention.

The present invention relates to the provision of link member 45 which may be of a selected length such as from 6 to 10 inches depending upon the difference in elevation desired at the front edge of drafting board 22. When it is desired to raise the drafting board to its second level the top edge of the board may be readily grasped by a hand, the bottom edge also grasped by the other hand, and the board lifted and drawn toward the draftsman so that link member 45 is pivoted about the axis of pivotal connection 48 and is substantially continuously moved toward the draftsman in an arc. Limitation on the pivotal movement of the link member 45 is provided by a stop element 50 located on base rail 30 and extending laterally into channel 33 so that the link member 45 is stopped at an angle of approximately 50° to 55° to the horizontal. As best shown in FIG. 2 link member 45 elevates the front edge of drafting board 22 over its position shown by phantom lines.

Adjustment of angular inclination of drafting board 22 is readily and substantially simultaneously accomplished and maintained by locating member rod in selected notches 43 in the base rail 30. Pivotal movement of the board at this level occurs about the pivot connection at 46.

Depending upon the location of drafting equipment on the board, alternate holes 40 and 47 are provided in board rail 36 so that the resultant gravitational load or force of the board and equipment will lie near or in front of pivotal connection 39. Positioning member 38 will be in compression and the board stabilized. In the low level position of the board 22 a releasable pin 51 may extend into board rail flange 35 to lock member 45 in parallel relation to flange 35. Release of pin 51 permits movement of the board to another level at which the board is also stabilized by gravitational forces, the members 45 and 38 being in compression and unwanted tilting being resisted thereby.

In fully collapsed position as shown in FIG. 3, it should be noted that the spacing of notches 43 is made at a preselected module, the spacing of holes 40, and the distance between pivotal connection 39 ad the axis of rod 42 are also related to the selected module so that the nuts and bolts used to make the connection will be received and accomodated in notches 43.

In the modifications of this invention shown in FIGS. 6–10, inclusive, only the differences in construction will be described. For brevity, parts identical to parts described in the first embodiment will be given similar reference numerals with a prime sign.

In FIG. 6, table base 21′ includes top base rail 30′ provided with a series of ratchet notches 43′. Drafting board 22′ includes angle section rail 36′ to which is pivotally connected as at 39′ the inclination positioning member 38′ having a transverse rod 42′ receivable within rachet notches 43′ on rails 30′ at sides of the table base.

At the forward end of each base rail 30′ a composite link means 60 is used in place of the single front link member 45. Link means 60 comprises a pair of link elements 61,62, pivotally interconnected at adjacent ends at 63. The lower end of link element 61 is pivotally connected to base rail 30′ as at 48′ and its forward movement is limited by stop 50′. The upper end of link element 62 is pivotally connected as at 46′ to board rail 36′ as previously described. To prevent collapse of the link elements 61,62 about their pivotal connection 63 in one direction, a stop rod 64 is provided on link element 61 to limit the included angle formed by the angular relationship of elements 61, 62. Stop rod 64 extends transversely beneath the board for interconnecting the link means 60 at each side of the table.

Figure 9:
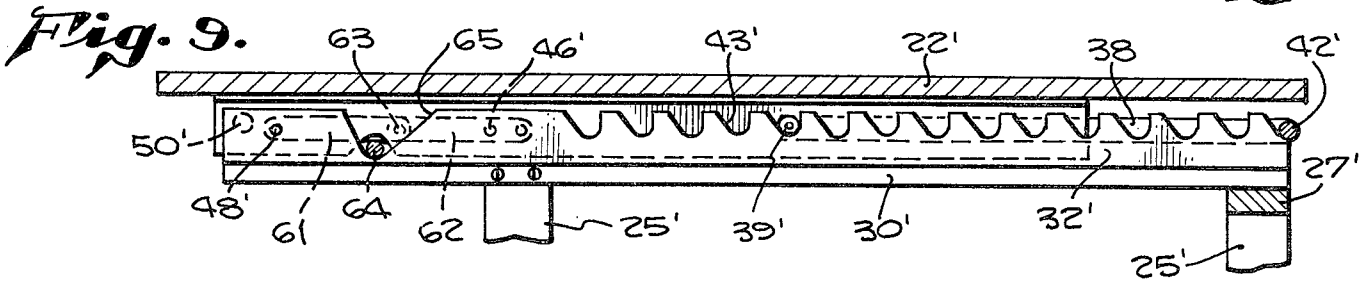
FIG. 9 is a sectional view similar to FIG. 6 showing the drafting board in fully collapsed horizontal position.
Figure 7:
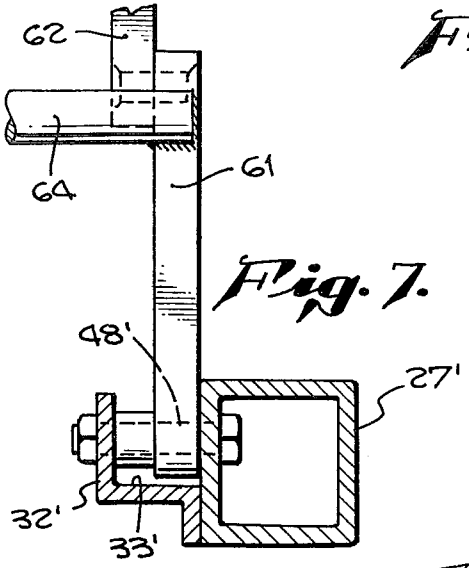
FIG. 7 is an enlarged fragmentary sectional view taken in the plane indicated by line VII—VII of FIG. 6.
Figure 8:
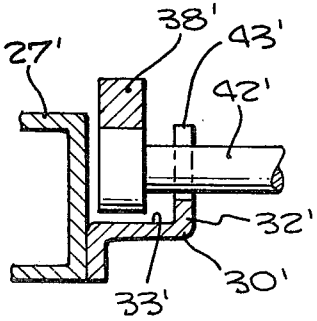
FIG. 8 is an enlarged fragmentary sectional view taken in the plane indicated by line VIII—VIII of FIG. 6.

As shown in FIG. 9, link elements 61,62 are permitted to move about their pivotal connection 63 so that the link elements may assume a linear relationship and be received within the channel 33′ when it is desired that the table board 22′ be positiond in horizontal flat relationship with respect to the table base 21′. Ends of rod 64 are accommodated in notch 65 provided in flange 32′ of rail 30′.

In the modification of the invention shown in FIG. 6 it will be readily apparent that the pivotal connection at 48′ provides a first pivotal means in the same manner as pivotal connection 48 of the first embodiment for angularly adjusting the inclination of drafting board 22′ by pivotal movement of the board about pivotal connection 48′. The board inclination is maintained by positioning members 38′.

When drafting board 22′ is raised to its upper elevation or level by forwardly lifting and pivoting board 22′ about pivotal connections 48′ in such a manner that link means 60 are brought to a forward stopped position against stops 50′, the upper link elements 62 are prevented from collasping by rod 64. In such position of link means 60 the front edge of the board is elevated a selected distance above the front edge of the board. When the link means 60 is in fully extended or linear relation, the amount of elevation between the two levels of the drafting board 22 is determined by the length of link member 45 in the first embodiment and primarily by the length of link element 61 in the second embodiment. The length of such link members is preselected depending upon the desired amount of difference between the two levels of the board 22, 22′. Slight modification of height may be obtained by selection of holes 46′, 46′*a* in element 62.

In FIG. 10 a further modification of link means 60 is shown. Link means 60′ includes link elements 61′ and 62′ pivotally connected at 63′. A transverse rod 64′ provides a stop to define an included angle of about 90°.

In this embodiment of the invention link element 62′ may be pivoted forwardly into linear relation with element 61′ and held in such relation by a stop bar 66 welded to the edge of either link element 61′, 62′. A third level for positioning the board 22′ is thus obtained.

In each of the embodiments of the invention shown changing the elevation of the board is accomplished as described in the first embodiment, that is, in a substantially uniform continuous lifting motion. Link members 38 and cross rod 42 provide adjustment to a selected board inclination at each neight or level.

It will be understood that various changes and modifications may be made in the drafting table construction described above which come within the spirit of this invention and all such changes and modifications coming within the scope of the appended claims are embraced thereby.

I claim:

1. In a multi-level adjustable drafting table construction having a table base supporting a drafting board, the combination of:

an upstanding base flange on said table base and a depending board flange on said drafting board adapted to nest in one position of the drafting board relative to the table base;

a first pivot means at said table base and said base flange and having a first pivot axis for moving said board into a first range of inclined positions relative to eh table base;

a second pivot means at said board flange and having a second pivot axis for moving said board into a second range of inclined positions relative to the table base and at a different level with respect thereto;

said second pivot means including link means interconnecting said first and second pivot means;

said link means being inoperative during positioning of the board in the first range of inclined positions and lying alongside said board flange;

and a stop means forwardly of the first pivot axis at the base flange and table base cooperable with a surface on the link means adjacent the first pivot axis whereby the link means is operable to position the second pivot means forwardly and above the first pivot means for the second range of inclined positions upon forward pivotal movement of said link means about said first pivot axis and against said stop means.

2. In an adjustable drafting table construction, the combination of:

a drafting board having side members provided with longitudinally extending depending flanges on the bottom face of said board;

a base frame provided with top rails having longitudinally extending upstanding flanges adapted to nest with the depending flanges on said board in a first position of the drafting board relative to the base frame;

means pivotally connecting said drafting board to said base frame including a first pivotal axis extending through said upstanding flange adjacent the front edge thereof;

a link member having one end pivotally mounted on said upstanding flange at said first pivot axis and having its other end pivotally connected to said depending flange on said drafting board rearwardly of said first pivot axis in said first position;

said link member and nested flanges lying in parallel relation when said drafting board is in said first position and providing pivotal movement of said drafting board about said first pivotal axis for selective inclination of said drafting board about said first pivotal axis;

a stop on said upstanding flange on said base forwardly of said first pivotal axis and engageable by said link member;

said drafting board being adapted to be lifted and moved forwardly on said link members by pivotal movement of said link members about said first pivotal axis and by pivotal movement of said drafting board about said second pivotal axis for moving the link members against said stops to position the drafting board at a different level for movement about said second pivotal axis to inclined positions of the drafting board at said different level;

and rearwardly extending members pivotally connected at one end thereof to said depending flanges on said drafting board and extending to said upstanding flanges on said base frame for maintaining selected inclined positions of the drafting board at each level.

3. In a drafting table construction as stated in claim 2 wherein said pivotal connections of said link member and said rear member are spaced from the front edge of the drafting board and from each other a selected distance whereby drafting board gravitational forces stabilize said board on said base frame.

4. In a table construction as stated in claim 2 wherein said link member includes a plurality of pivotally interconnected link elements and stop means between said elements to determine relative included angles between said link elements whereby said drafting board is positionable at more than one level and adjustably inclinable at each level.

* * * * *